US006247603B1

(12) United States Patent
Farrell et al.

(10) Patent No.: US 6,247,603 B1
(45) Date of Patent: Jun. 19, 2001

(54) CONTAINER COATING FOR INCREASING PRODUCT OUTAGE

(75) Inventors: Christopher J. Farrell, Arlington Heights; Joseph Plewa, Park Ridge, both of IL (US)

(73) Assignee: Continental Plastic Containers, Inc., Elk Grove Village, IL (US)

( * ) Notice: Subject to any disclaimer, the term of this patent is extended or adjusted under 35 U.S.C. 154(b) by 0 days.

(21) Appl. No.: 09/377,848

(22) Filed: Aug. 20, 1999

(51) Int. Cl.[7] ..... B65D 23/00
(52) U.S. Cl. ..... 215/12.2
(58) Field of Search ..... 215/12.2

(56) References Cited

U.S. PATENT DOCUMENTS 4,393,106 * 7/1983 Maruhashi et al. ..... 215/12.2
4,451,512 * 5/1984 Yazaki et al. ..... 215/12.2
5,378,510 * 1/1995 Thomas et al. ..... 215/12.2

* cited by examiner

*Primary Examiner*—Philippe Derakshani
(74) *Attorney, Agent, or Firm*—Sonnenschein, Nath & Rosenthal

(57) ABSTRACT

A dispensing apparatus and method for increasing product removal utilizing a coating. The apparatus includes a container having an outlet, a wall and a chamber. The chamber houses the coating and a product. The coating substantially covers the container wall. The product is dispensed through the container outlet without substantially removing all the coating applied to the container wall.

16 Claims, 1 Drawing Sheet

CONTAINER COATING FOR INCREASING PRODUCT OUTAGE

BACKGROUND OF THE INVENTION

The present invention relates generally to the dispensing performance of containers. More specifically, the present invention relates to dispensing apparatuses and methods for increasing the removal of a product being dispensed from a container.

Many consumer household products, such as food, cleaning or bathing products, are stored and dispensed from a container. When dispensed, some products easily flow from the container and thus leave little, if any, residual product in the container.

However, some viscous products are sticky and thick by nature and thus do not freely flow from the container, particularly where the container has a narrow mouth or opening. For example, these products may include bathing products, such as shampoos and conditioners, food products, such as mayonnaise, mustard and ketchup, and cleaning products, such as dishwasher detergents. Due to the viscous nature of these products, an appreciable amount of the product cannot be dispensed by normal use and thus remains unused as it is disposed along with the paid for product.

To address this problem, some have attempted to modify the shape of the container to facilitate dispensing performance. For example, some have designed the container to have a gently sloping shoulder to improve dispensing performance. Whereas, others have designed valve or nozzle assemblies for pumping the product from such a container. However, such prior attempts to address the outage problem have focused on either redesigning of the container or using additional apparatuses, which are thus costly to the manufacturer and ultimately the consumer.

Alternatively, the consumer may take matters into his or her own hands by leaving the container up-turned or shake and hit the container to further dispense the product. However, the dispensing of the product through the outlet, particularly as the container becomes progressively more empty, can take, or seem to take, a significant and frequently frustrating amount of time. In addition, if the container is vigorously shaken or hit, the dispensing product is less easily controlled as it exits the container, thus creating the potential for the product to be unexpectedly spilled onto a counter top, a floor or even an end user.

Therefore, a need exists for an improved apparatus to increase the dispensing of relatively viscous liquids from a container, such as plastic containers with narrow outlets. Such a device should allow the product to flow essentially uninhibited from the container, thereby maximizing the amount of product that may be dispensed under normal consumer use. As a result of an increase in product removal, namely the product outage, consumer satisfaction will likely increase because less product will go to waste.

SUMMARY OF THE INVENTION

The present invention provides a unique dispensing apparatus and method for increasing the removal of product being dispensed from its container. To increase product removal, the present invention employs a coating that is applied to the inner wall of the container. The product then contacts the coating instead of the bare container wall surface. In doing so, the product slips with the coating as it flows from the container during normal use, thereby increasing product removal because less product is capable of adhering to the bare container walls. Accordingly, greater product removal maximizes the amount of product being used by the consumer through normal use prior to the disposal of the container.

Pursuant to the present invention, the dispensing apparatus for increasing product removal includes a container having an outlet and a wall; the wall having a wall inner surface. The wall inner surface defines a chamber housing a coating and a product. The coating substantially covers the wall inner surface, thereby defining a coating surface. The product is in contact with at least a portion of the coating surface.

A variety of suitable coatings may be used to facilitate product removal. In an embodiment, the coating is natural oil or mineral oil. The natural oils are esters of glycerol and a variety of fatty acids; whereas, the mineral oils are hydrocarbon-based compounds. For example, olive oil or soybean oil are specific examples of suitable natural oils.

The container may be made from a variety of different materials. For example, the container can be made from plastic, metal or glass.

The present invention also provides a dispensing method for increasing product removal. In an embodiment, the dispensing method includes providing a container having an outlet and a wall having a wall inner surface defining a chamber. Next, an amount of coating is applied to the wall inner surface. The coating substantially covers the wall inner surface thereby defining a coating surface. Next, an amount of product is placed into the chamber. In doing so, the product contacts at least a portion of the coating surface. Since the product contacts the coating surface instead of the wall inner surface, the product slips with and/or across the coating surface as the product is dispensed from the opening thereby increasing product removal.

The coating may be applied to the container wall with a variety of different application techniques. In an embodiment, the coating is applied to the wall inner surface with the use of a gravitational force acting on the coating. In another embodiment, the coating is radially sprayed onto the wall inner surface. In still another embodiment, the coating is applied to the wall inner surface by a centrifugal force acting on the coating. In a further embodiment, coating may be deposited locally on the bottom center of the container, just before the container is filled with product. As the product fills from the centerline of the container outwards, it spreads the coating (i.e. oil) between itself and the container wall surface.

An advantage of the present invention is that it provides an improved dispensing apparatus and method for increasing product removal that is effective during normal product use.

Another advantage of the present invention is that it may be adapted for use with a variety of different consumer household products, such as bathing, cleaning and food products.

Still further, another advantage of the present invention is that it may be adapted for use with containers of varying shapes and sizes.

Moreover, an advantage of the present invention is that is provides a relatively simple apparatus, compared to prior apparatuses, for increasing product removal from a container.

Another advantage of the present invention is that it utilizes coatings that are safe in food products since the coatings themselves are food products.

Additional features and advantages of the present invention are described in, and will be apparent from, the detailed description of the presently preferred embodiments.

DETAILED DESCRIPTION OF THE PRESENTLY PREFERRED EMBODIMENTS

The present invention provides a dispensing apparatus and method for increasing product removal from a container. The invention uniquely incorporates the use of a coating to increase the removal of a product. The coating is applied to the inner surface of the container wall. Since the product contacts the coating surface as opposed to the inner wall surface, the product will slip with and/or across the coating and not stick to the wall surface, thereby improving product removal.

Figure 1:
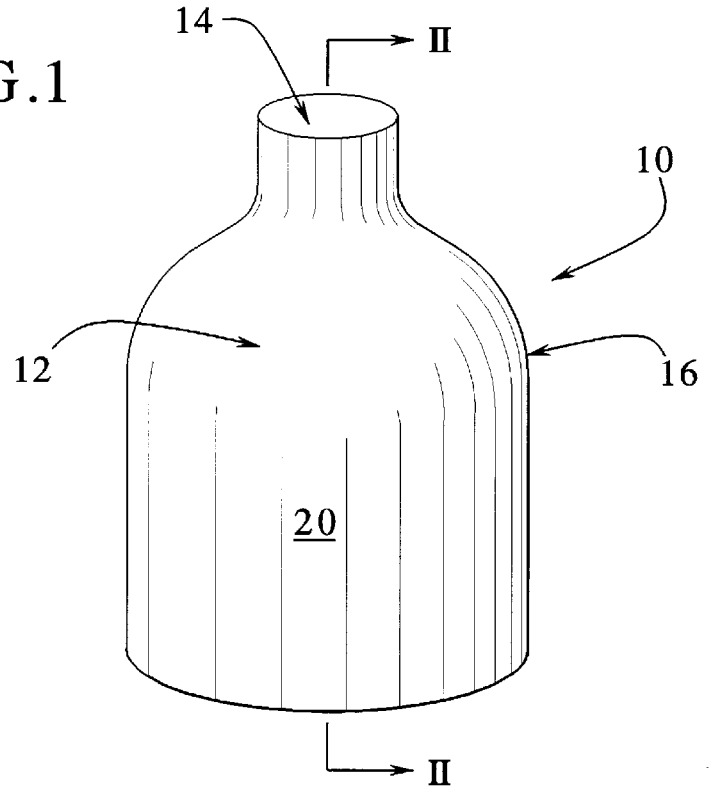
FIG. 1 is a perspective view of a dispensing apparatus for increasing product removal of the present invention.
Figure 2:
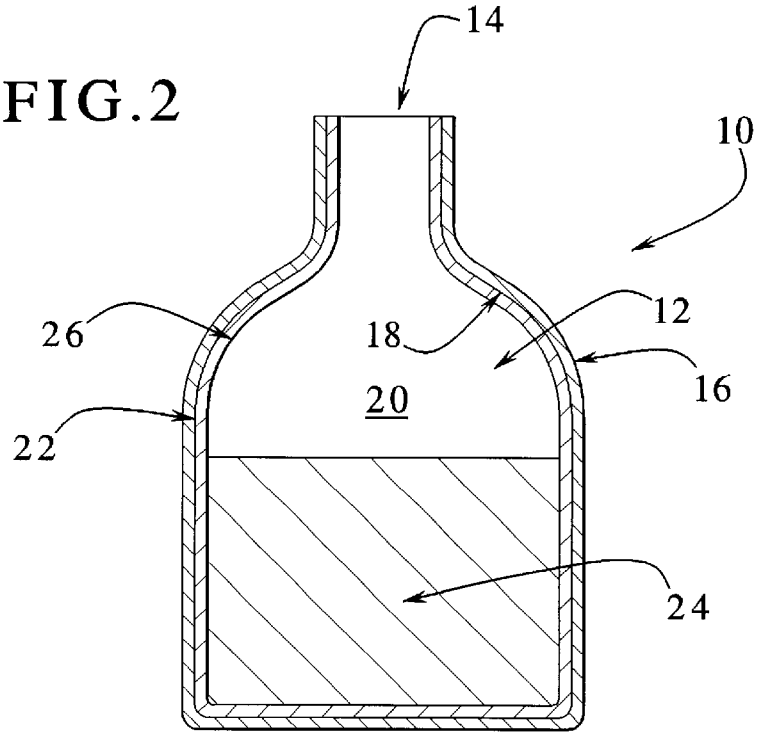
FIG. 2 is a sectional view of a dispensing apparatus taken substantially along the plane of line II—II in FIG. 1.

Referring now to the drawings, wherein like numbers refer to like parts, FIGS. 1 and 2 illustrate a dispensing apparatus 10 that includes a container 12 having an outlet 14 and a wall 16. The wall 16 has a wall inner surface 18 that defines a chamber 20. The container 12 is preferably made of plastic. However, the container 12 may be made from a variety of different materials such as metal and glass. In addition, the container 12 can be formed in a variety of different shapes and sizes.

To maximize product removal, an effective amount of a coating 22 is applied to the wall inner surface 18 of the container 12. The coating 22 should preferably exhibit certain general properties in order for it to effectively increase product removal. First, the coating 22 should be essentially immiscible in the product 24 and virtually non-absorbent in the wall 16 of the container 12. It should also be able to adhere sufficiently to the wall inner surface 18 so that it does not easily flow from the wall inner surface 18, while at the same time it must be able to be easily applied or spread across the wall inner surface 18. For the coating 22 to flow preferentially as compared to the product 24, it may have a viscosity ranging from about 50 to about 100 centi-poise, while the product itself could have a viscosity in the region of 250,000 centi-poise. For easy spreading, the coating should also have a surface energy less than the surface energy of a bottle wall. In the case of a container wall made from high-density polyethylene, this value is typically about 35 dynes/cm.

As one of skill in the art would recognize, a variety of suitable coatings can be used that exhibit the general properties described above. Known fluids that preferably exhibit the requisite coating 22 properties are natural and mineral oils. The natural oil are esters of glycerol and fatty acids; whereas, the mineral oil are hydrocarbon-based compounds. Examples of natural oil that are suitable in the present invention include, but are not limited to, soybean and olive oil. These oils have a further advantage when used to dispense food products because they are themselves foods.

An effective amount of coating 22 should be applied to the wall inner surface 18. If too much oil is used, it will pool onto the inner wall surface 18 and thus will be unsightly and distract from the functioning of the product. On the other hand, if too little oil is used, then even slight absorption by the plastic or product may reduce it further until there is not enough present to effectively function as a slip layer.

Naturally, the precise amount of coating necessary to make a coating surface 26 depends on the size of the container. For example, a suitable amount of coating 22 ranges from about 0.5 grams to about 5.0 grams for a 12 ounce container. In a preferred embodiment, at least about 3 grams of coating 22 is applied to a container having an approximate volume of 12 ounces as demonstrated below in EXAMPLE 1. This applied amount of coating 22 results in about 0.05 grams of coating/in$^2$ of surface area.

In this example, once the coating 22 is applied to the container 12, the product 24 can then be placed inside the container chamber 20. As noted above, in another embodiment, the coating 22 is spread by the product 24 itself by depositing the coating on the bottom of the container and allowing the coating to spread as the product is disposed in the container. Inside the container 12, the product 24 contacts at least a portion of the coating surface 26. The product 24 can include a variety of dispensable consumer household products. For example, the dispensing container can be used to dispense household products, such as bathing, cleaning and food products and especially for products that are viscous in nature, such as shampoos, conditioners, dishwashers and mayonnaise. As the product 24 is being dispensed from the outlet 14 of the container 12, the product 24 slips across the coating surface 26 without substantially removing all the coating 22 applied to the wall 16. In other words, as the product 24 is dispensed from the container 12, while a portion of the coating 22 may be removed along with the product 24, at least some coating stays on the wall surface to remain functional. By doing so, product removal is increased because the coating interface between the product 24 and wall inner surface 18 greatly reduces the amount of product 24 that adheres to the container 12.

The present invention further provides a dispensing method for increasing product removal. The dispensing method employs a container 12, coating 22 and product 24 as previously described. As one of skill in the art would recognize, a variety of techniques may be utilized to apply the coating 22 to the container wall 16. One preferred application technique is by means of gravitational force. An amount of coating 22 is placed in the container 12 and allowed to drain by placing the container 12 upside down. The coating 22 spreads across the wall inner surface 18 due to a gravitational force acting on the coating 22. Another preferred application technique is by means of spraying. Utilizing this technique, the coating 22 is sprayed into the outlet 14 of the container 12. Further, a preferred application technique is by means of centrifugal force. During this application technique, the coating 22 is applied to the container 12 by a centrifugal force acting on the container 12. Any standard centrifuge device may be utilized provided that it may be adapted to accept the shape and size of the container being used. Lastly, the product itself can be used to spread the coating 22 on the container wall 16. As the product fills from the centerline of the container outwards, it spreads the coating 22 between itself and the container wall surface.

Of course, the present invention is not limited by the type of application technique that is utilized to apply the coating 22 to the container 12. Any application technique that allows for the applying of an effective amount of coating may be used in the present invention.

By way of example, and not limitation, experimental examples of the present invention will now be given.

EXAMPLE 1

The following laboratory procedure was used to demonstrate the efficacy of an embodiment of the present invention. Approximately 50 grams of soybean oil was poured into a plastic bottle of a nominal 12 ounce capacity. The bottle was made from high-density polyethylene. The bottle was rectangular in shape having a 2.85 inch width and 1.8 inch depth. In addition, the outlet was circular in shape having a diameter of about 1.4 inches. The inner surface area was 55 square inches.

The soybean oil was shaken in the bottle and then drained by holding the bottle upside-down for one minute. After that time, approximately 3 grams of soybean oil remained in the bottle. Next, about 12 ounces of two different formulations of hair-conditioner designated L and R were placed in the bottle. These formulations were oil-in-water emulsions. The oil was a silicone-based oil. The water-phase contained mixtures of detergents. The conditioners had a viscosity of about 250,000 poise as measured in a Brookfield Viscometer. Additionally, bottles that were not treated with soybean oil were also filled with L and R conditioners.

After a one and eight week period, bottles were examined to determine the product removal performance as measured by percentage of product dispensed (% weight) and percentage of residual product remaining in the container (% weight). After one week, the bottles were opened, inverted and gently shaken. Bottles that had not been treated with soybean oil dispensed 89.4% of the R conditioner, leaving a residual of 10.6% by weight. Bottles that had been treated with soybean oil dispensed 97.5% of the R conditioner, leaving a residual of 2.5%. Similar results occurred with the L conditioner. The residual conditioner in the untreated bottle was 9.2% as compared to 1.4% in the soybean oil treated bottle. After an eight-week period, the soybean oil treated bottle dispensed 95.5% of the R conditioner.

EXAMPLE 2

The following laboratory procedure was used to demonstrate the efficacy of another embodiment of the present invention. In this procedure, the bottle was made of polyethylene terephthalate. The bottle was cylindrical in shape having about a 2.46 inch diameter and a volume of about 11.2 fluid ounces. The outlet of the bottle was circular in shape, measuring about one inch in diameter.

Three different coatings were used, namely soybean, olive and mineral oil. Each coating was applied to the bottle in a similar manner as the coating in EXAMPLE 1. Once applied, the oil-treated bottles and untreated bottles were filled with the same product as in EXAMPLE 1.

The bottles were left for a period of seven and twelve days after which time the product removal was measured as in EXAMPLE 1. After seven days, the bottle treated with mineral oil, the untreated bottle and the soybean treated bottle had product residual measurements of 11%, 15.9% and 8.8%, respectively. After twelve days, the olive oil treated bottle had a 10.2% product residual measurement.

EXAMPLE 3

The following laboratory procedure was used to demonstrate the efficacy of a further embodiment of the present invention. Approximately 50 grams of soybean oil was again poured into a plastic bottle of a nominal 12 ounce capacity. The bottle was made from high-density polyethylene. The bottle was rectangular in shape, being 2.85 inches wide and 1.8 inches deep. In addition, the outlet was circular in shape having a diameter of about 1.4 inches. The inner surface area was 55 square inches. The soybean oil was shaken in the bottle and then drained by holding the bottle upside-down for one minute. After that time, approximately 3.5 grams of soybean oil remained in the bottle. Next, cheese sauce was filled into the bottle up to the bottom of its neck.

The cheese sauce was stored in oiled and non-oiled bottles, was refrigerated for two weeks and then brought to room temperature. The bottles were opened, inverted and gently shaken. Bottles that had not been treated with soybean oil dispensed 90.4% of the cheese sauce, leaving a residual of 9.6% by weight. Bottles that had been treated with soybean oil dispensed 98.9% of the sauce, leaving a residual of 1.1%.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by claims.

What is claimed is:

1. A dispensing apparatus for increasing product removal, the apparatus comprising:

a container comprising an outlet and a wall having an inner surface, the wall inner surface defining a chamber, a liquid coating on the inner surface; and a product in the container, wherein, the coating substantially covers the wall inner surface, is immiscible in the product, is liquid a room temperature, and is substantially non-absorbent to the wall.

2. The dispensing apparatus of claim 1 wherein the coating has a viscosity ranging from about 50 to about 100 centi-poise.

3. The dispensing apparatus of claim 1 wherein the coating is selected from the group consisting of natural oils and mineral oil.

4. The dispensing apparatus of claim 1 wherein the coating is selected from the group-consisting of soybean oil, olive oil and mineral oil.

5. The dispensing apparatus of claim 1 wherein the container is made from plastic, metal or glass.

6. The dispensing apparatus of claim 1 wherein the product is selected from the group consisting of food products, bath products, and cleaning products.

7. A dispensing method for increasing product removal, the method comprising the steps of:

providing a container including an outlet and a wall having a wall inner surface, the wall inner surface defining a chamber;

applying a liquid coating to the wall inner surface so as to substantially cover the wall inner surface, the coating being a liquid a room temperature and substantially non-absorbent to the wall;

disposing a product into the chamber, the coating being immiscible in the product; and dispensing the product through the outlet of the container without substantially removing the coating applied to the wall inner surface.

8. The dispensing apparatus of claim 7 wherein the coating has a viscosity ranging from about 50 to about 100 centi-poise.

9. The dispensing apparatus of claim 7 wherein the coating is selected from the group consisting of natural oils and mineral oil.

10. The dispensing apparatus of claim 7 wherein the coating is selected from the group consisting of soybean oil, olive oil and mineral oil.

11. The dispensing method of claim 7 wherein the container is made from plastic, metal or glass.

12. The dispensing method of claim 7 wherein the product is selected from the group consisting of food products, bath products, and cleaning products.

13. The dispensing method of claim 7 further comprising applying the coating to the wall inner surface with gravitational force.

14. The dispensing method of claim 7 further comprising radially spraying the coating to the wall inner surface.

15. The dispensing method of claim 7 further comprising applying the coating to the wall inner surface with centrifugal force.

16. The dispensing method of claim 7 further comprising:

depositing the coating on a bottom surface of the chamber; and spreading the coating on the wall inner surface with the product as the product is being disposed into the chamber.

* * * * *